United States Patent [19]

Hammerquist et al.

[11] Patent Number: 4,975,723

[45] Date of Patent: Dec. 4, 1990

[54] PAPER-PROCESSING CONTROL APPARATUS

[75] Inventors: Kenneth G. Hammerquist, Bellevue; Maxwell G. Maginness, Redmond; Gordon L. Overbye, Seattle, all of Wash.

[73] Assignee: Gretag Systems, Inc., Bothell, Wash.

[21] Appl. No.: 473,896

[22] Filed: Feb. 2, 1990

[51] Int. Cl.[5] ..... G03D 3/13

[52] U.S. Cl. ..... 354/298; 354/321; 354/322; 226/119

[58] Field of Search ..... 354/319, 320, 321, 322, 354/316; 355/27; 226/118, 119

[56] References Cited

U.S. PATENT DOCUMENTS

| | | | |
|---|---|---|---|
| 2,169,061 | 8/1933 | Tondreau | 226/119 |
| 2,853,294 | 9/1958 | Woodcock | 226/119 |
| 3,913,119 | 10/1975 | Pfeifer et al. | 354/298 |

*Primary Examiner*—A. A. Mathews

*Attorney, Agent, or Firm*—Christensen, O'Connor, Johnson & Kindness

[57] ABSTRACT

A web-handling system for use in the processing of photographic print paper during the developing process includes a plurality of rollers mounted in a developing tank, at least some of the rollers being movable to vary the length of the paper path through the tank. The paper path length is continuously monitored and the input and output speed of drive rollers that move the paper into and out of the tank is controlled so that the path length is of the proper value to maintain the paper within the tank for a predetermiend time regardless of the rate of input of paper to the tank. The movable rollers are mounted on a carriage that is supported by the paper web when the handling system is in dynamic operation. A monitoring sensor is positioned near the input to the tank to monitor the transverse position of the paper web with respect to the paper path defined by the rollers and a roller adjustment device is controlled by the sensor to adjust the web position to maintain alignment of the web with the paper path.

16 Claims, 5 Drawing Sheets

PAPER-PROCESSING CONTROL APPARATUS

BACKGROUND OF THE INVENTION

This invention relates to the handling and control of a continuous web of photographic paper as it is moved through the processing steps required to develop exposed portions of the photographic paper to produce photographic prints. More particularly, the invention relates to an apparatus for controlling the amount of time that the paper spends in various baths associated with the developing process, regardless of the speed at which paper is fed to the developing baths from a photographic printer that runs at its own nonconstant rate.

In the photoprocessing industry photographic prints are produced on a continuous web of photosensitive paper that is exposed to the image-forming light in a printer. In most commerical photoprocessing laboratories the exposed paper is collected on a reel in a light-tight canister and carried from the printer to the developing baths that fix the image on the paper. It would be desirable to be able to run the paper from the photoprinter directly into the chemical baths without removal and manual handling of the film in order to speed the efficiency of the developing process by eliminating as many operator interventions as possible. One of the inherent problems in such a direct feed from the printer to the developing baths is the output of the paper from the printer is not usually a constant rate. The rate of output from the printer is affected by the type of operation occurring in the printer for any given batch of photos. At times the printer may be printing double prints of orders, while at other times the printer may be skipping over frames in the negative and printing only selected frames for reprints. The printer may be printing single prints from each frame. All of these different operations take different times to accomplish so that the speed of the printer is a variable with no advance predictability.

On the other hand, the developing process has very strict time constraints on it. For example, it is necessary to immerse the photographic paper in the various developing and fixing baths for precise amounts of time. In currently used developing systems the path through the baths is a fixed length. Therefore, the speed of travel of the web through the developing bath is a constant so that the paper travels the fixed length in a constant time. If the output of the printer were to be fed directly into the developing baths, a discrepancy would exist between the variable output rates of the printer and the necessity of constant rate within the developing bath. For this reason, current thinking on the subject proposes the use of large storage bins or buffers that would accept the output from the printer and build up a large enough stock of such exposed photographic paper that the paper could then be fed into the developing baths at a constant rate, while continuing to accept paper from the printer at an uneven rate, with the intermediate storage bin buffering the effect of the uneven printer output rate. One problem with this concept is that the large volume of photographic paper being processed each day in the lab requires a very large buffer or storage space, which is prohibitive due to the space constraints present in most laboratories or because of the inefficiency of having to lease additional space in order to handle the storage buffer. Also, it is undesirable to have large quantities of exposed but unprocessed paper contained in a relatively complex large buffer device that is subject to breakdowns.

SUMMARY OF THE INVENTION

In order to provide for the direct input of photographic paper from a photoprinter to a tank containing developing chemicals, an apparatus is disclosed that provides a variable-length paper path through the developing tank in order to maintain the time of immersion of the paper at a constant value. A sensor keeps track of the length of the paper path through the developer and provides a feedback to the output speed control to maintain synchronism between the input and output speeds of paper to and from the tank. The paper path through the tank is defined by a series of rollers. At least some of the rollers are free to move vertically to vary the length of the path that the paper travels through the solution in the tank so that, regardless of input rate, the paper is submerged in the developing baths for a predetermined time.

In a preferred embodiment of the invention the paper web is monitored as it is fed into the developing tanks to detect any transverse movement of the web with respect to the feed rollers. Such movement could cause the web to accidentally ride off the edge of one of the rollers and become jammed in the mechanism, thereby destroying the web. In the illustrated embodiment, an infeed path adjustment roller is positioned at the input to the developing tank and is adjustable in response to a position signal from the monitoring device that indicates that the paper web has shifted its transverse position on the roller. An adjustment system varies the angle of the path adjustment roller to force the paper web back into proper alignment with the remaining rollers in the system.

In some applications it may be desirable to include a short mechanical buffer in the paper path between the output of the printer and input to the tank. The short buffer would smooth out short-term fluctuations in printer output rate.

BRIEF DESCRIPTION OF THE DRAWINGS

The invention disclosed herein will be better understood by those of ordinary skill in the art and others upon reading the ensuing specification, taken in conjunction with the appended drawings, wherein.

DETAILED DESCRIPTION OF THE PREFERRED EMBODIMENT

Figure 1:
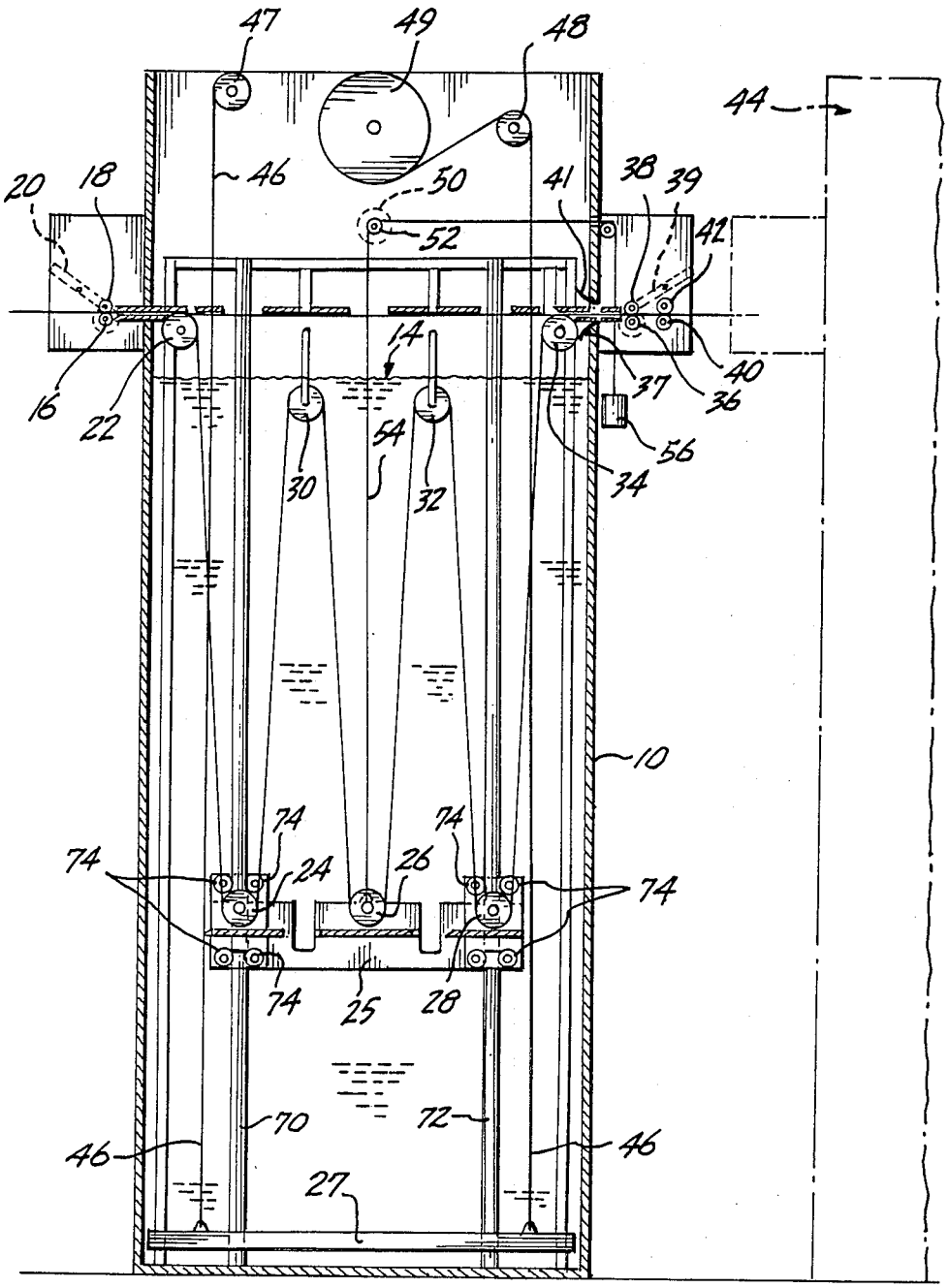
FIG. 1 is a side elevational view of a tank containing a developing bath having an apparatus for controlling the input and output of a web to the bath made in accordance with the principles of the present invention installed therein.

FIG. 1 illustrates a single tank that could be used in, for example, the developing process for photographic prints. In a typical situation a plurality of these tanks would be mounted in series and filled with various developers, fixers, and washes. The photographic paper is run through each of the tanks in succession and undergoes the appropriate chemical processing in order to produce at the end a fixed photographic print. Therefore, while only one tank is shown in FIG. 1, it will be understood that the input to the tank 10 could either be from a previous tank or from a photographic printer, while the output from tank 10 could be directed either to a print-handling mechanism or to a subsequent tank containing another solution used in the developing process.

Typically, the photographic paper will be in the form of a continuous web 12, which has several prints photographically exposed on it. The tank 10 contains a solution through which the photographic paper must pass in the developing process. The level of the solution in the tank is indicated by the line 14. The photographic processing is dependent upon submersion of the photographic paper in the solution within tank 10 for some predetermined time, depending on the particular solution and processing taking place. As discussed earlier, since the infeed to the tank 10 could come directly from the output of a photographic printer that outputs material at variable rates, the input of photographic paper to the tank 10 will not be a constant. In order to maintain a constant immersion time of the photographic paper 12 in the tank 10, when the input speed of the web is not constant, the length of the path that the web 12 travels through the tank 10 is varied so that the total immersion time remains the same. That is, if the input speed increases then the path length must also increase and, alternatively, if the input speed decreases the path length must decrease in order to maintain the paper 12 in the tank 10 for a predetermined constant time.

The web 12 is received in the nip formed by a roller pair comprised of a drive roller 16, which is preferably driven by a stepper motor (not shown), and a pressure roller 18 that is rotatably mounted at a first end of a spring arm 20. The spring arm 20 is biased in a downward direction to keep the pressure roller 18 forced against the drive roller 16 to maintain a grip on the paper web 12.

As the drive roller 16 moves the paper web 12 into the tank 10, the paper web passes over and under a series of rollers that define the paper path through the tank. As viewed in FIG. 1, the system of paper handling is shown in its dynamic state with the paper web 12 passing over a roller 22 rotatably mounted to an upper portion of the tank at the input side. The web 12 passes under a roller 24 that is rotatably mounted on a carriage assembly 25 that can move vertically within the tank. Two other rollers 26 and 28 are rotatably mounted on the carriage 25 and the paper web 12 passes beneath the rollers 26 and 28 after it has alternately passed over rollers 30 and 32, which are rotatably mounted at the upper portion of the tank 10. After the paper web 12 passes beneath the roller 28 it then travels upwardly in the tank 10 and passes over another stationarily mounted roller 34. The web then exits the tank and is grabbed by the nip of a pair of drive rollers 36 and 38. The exit drive roller 36 is driven by a stepper motor (not shown) and an exit pressure roller 38 is mounted on one end of a swing arm 39 that is biased downwardly to keep the exit pressure roller 38 biased against the exit drive roller 36 to maintain the paper web 12 in contact with the exit drive roller 36. The exit drive roller pulls the web 12 out of the tank 10. A pair of conventional squeegee blades 37 and 41 are positioned on opposite sides of the web 12 to remove any excess moisture from the web. A pair of rollers 40 and 42 are paired up to form a nip downstream from the exit drive rollers 26. The function of rollers 40 and 42 is primarily to aid the squeegee blades to squeeze the paper web sufficiently to remove a portion of the liquid that clings to the web due to its immersion in the developing liquid within tank 10. After passing through the squeeze rollers 40 and 42 the paper web 12 moves on to a next tank 44 shown in phantom in FIG. 1. The tank 44 would contain another paper-handling system similar to the one described. Alternatively, if the tank 10 were the final tank utilized in processing the paper, the processing would then be complete at the exit of the web from tank 10 and the paper web would be passed into a dryer. Once dry, the web can be coiled into a reel, which is then mounted in a print-cutting device that does not form a part of this invention, for severance of the prints into individual photographs.

The carriage 25 contains rollers 24, 26, and 28 and is initially suspended in the tank 10 by a basket 27 that underlies the carriage 25. The basket 27 is, in turn, suspended from a cable 46. Cable 46 is rigged through a series of pulleys, such as 47 and 48, and connected to a motor 49 so that the cable 46 can be retracted and the basket 27 can be raised and lowered within the tank 10. The basket 27 carries the carriage 25 with it. The cable 46 is used primarily to lift the basket 27 and the carriage 25 out of the solution, either when a new paper web must be threaded through the rollers on the carriage or if there is some maintenance work to be performed on the tank, the rollers, or the carriage, itself. The basket 27 also catches any items that may fall into the tank and allows them to be retrieved. Under typical operating conditions, the cable 46 is released so that the basket 27 is free to drop to the bottom of the tank 10. The carriage 25 is then supported only by the paper web 12 itself, which passes underneath the rollers 24, 26, and 28 and the tension of the paper web 12 then supports those rollers and, in turn, the carriage 25.

In order to maintain the proper paper path length required to provide the desired immersion time for the web 12, it is necessary to monitor the vertical position of the carriage 25. In the illustrated embodiment, the carriage 25 position is monitored by an encoder 50 that is mounted at the upper portion of the tank 10 above the stationary rollers 22, 34. A spindle 52 is attached to the encoder 50 and a cable 54 runs over the spindle 52 and is attached at one end to the carriage 25 and at a second end to a tension-biasing means, for example, the weight 56. As the carriage 25 is raised and lowered within the tank the cable 54 will move over spindle 52. This movement will, in turn, rotate the encoder 50. By keeping track of the output of the encoder 50 it is possible to maintain a continuous observation of the vertical position of the carriage 25. The position of the carriage can be used to determine the paper path length. Instead of the weight 56, other tensioning means, for example, a spring system, could be used to keep the tension on the cable 54. Also, other position-sensing means could also be used to track the movement of the carriage 25, for example, acoustic sensors.

Figure 2:
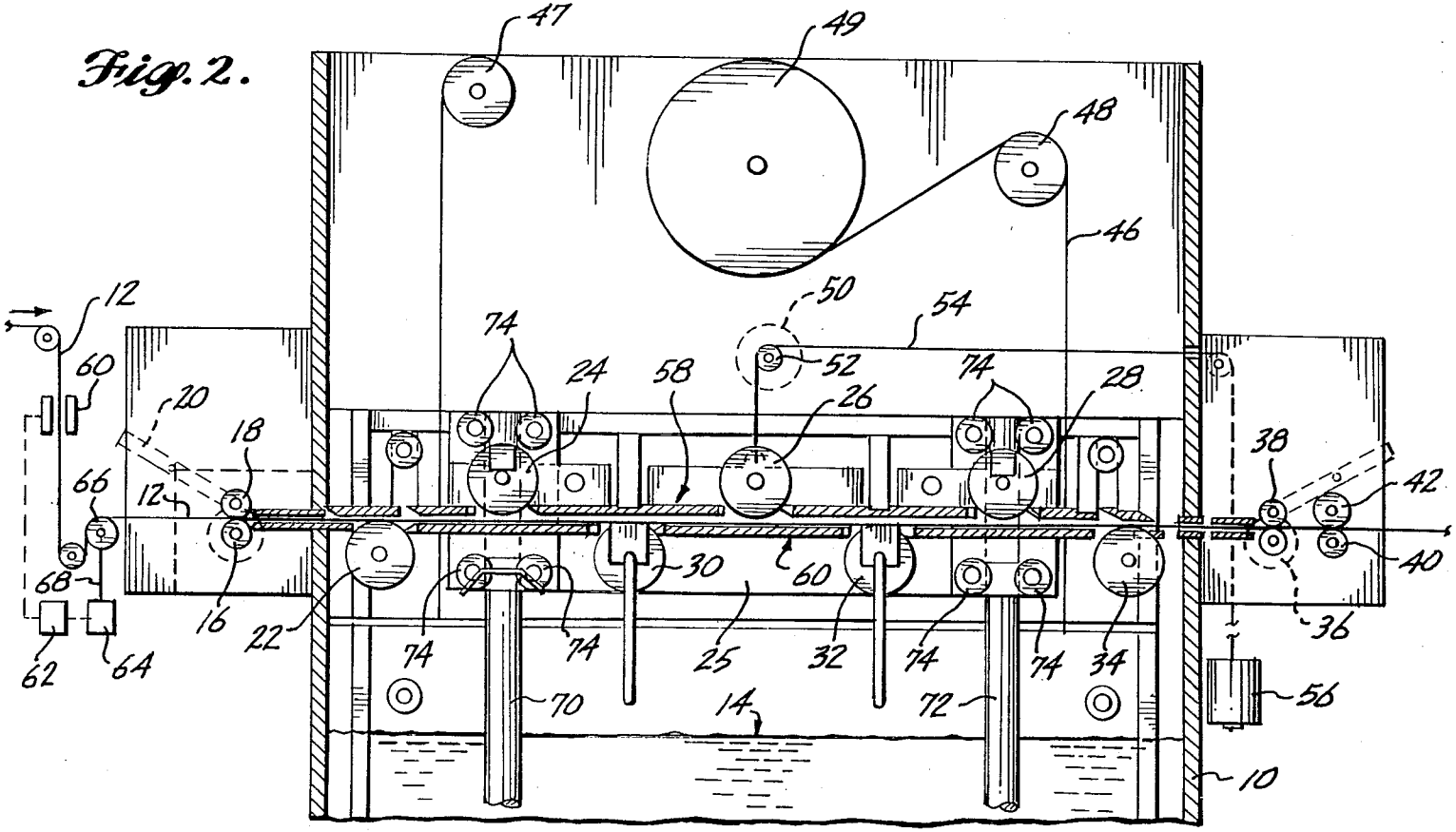
FIG. 2 is a side elevational view of the upper portion of the tank showing the control apparatus of FIG. 1.

Turning now to FIG. 2, a more detailed view is given of the upper portion of the tank 10 with the paper-handling apparatus made in accordance with the principles of the present invention shown thereon. In FIG. 2 the carriage 25 is shown in its uppermost position so that all of the rollers, both those mounted on the tank and those mounted on the carriage, are in position to accept a newly fed paper web from the left. The web 12 passes between aligned upper and lower guide members 58 and 60, respectively, that form a channel within which the web can travel directly across the upper portion of the tank 10 to the exit rollers 36 and 38 at the exit side of the tank. Comparing FIG. 1 and FIG. 2, it can be seen that, once the web has been fed across the tank from the input feed rollers 16, 18 to the output rollers 36, 38, the carriage 25 is released and gravity causes the carriage 25 to drop vertically within the tank 10 to a position and at a rate determined by the tension on the web 12. The rollers 24, 26, and 28 rest on top of the web 12 and carry the web downwardly with them as the carriage 25 drops. The rollers 30 and 32 move downwardly to position the web 12 below the surface 14 of the solution in the tank 10. As discussed earlier, the cable 54, which is attached to the carriage 25, is pulled over the pulley 52 as the carriage drops, thereby turning the encoder 50 and providing a signal from the encoder, which can be monitored to provide information on the vertical position of the carriage 25 and, thereby, the length of the paper path through the solution.

Figure 4:
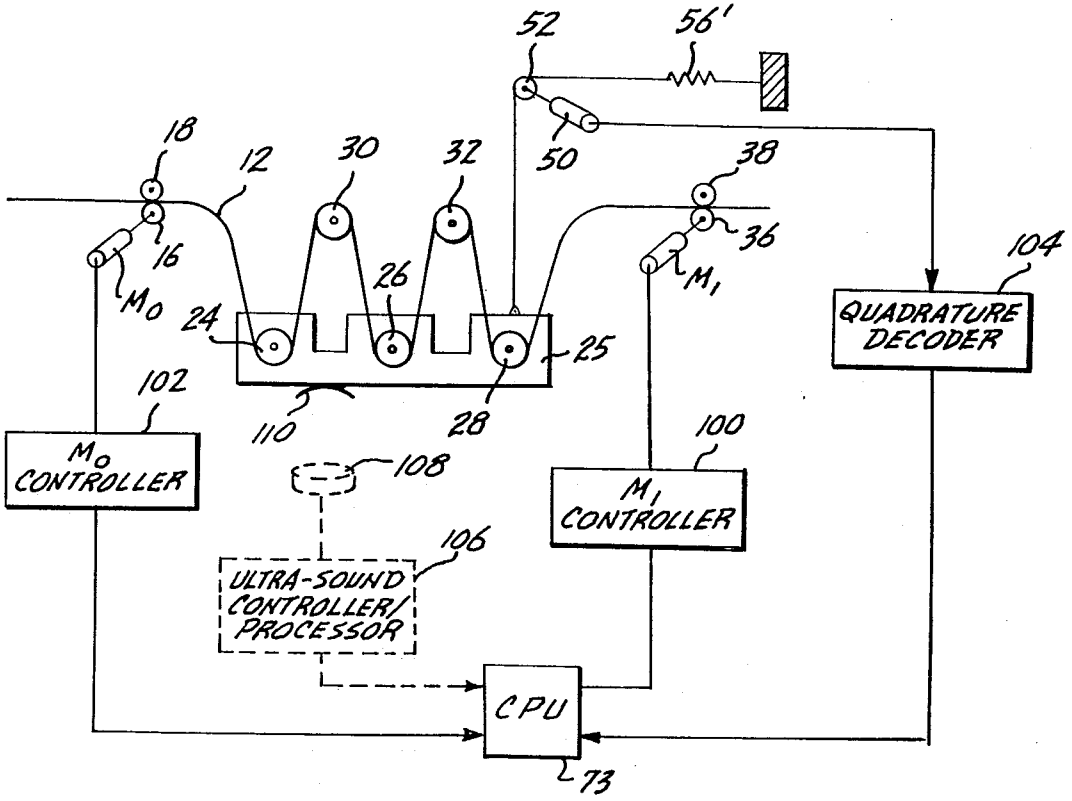
FIG. 4 is a block diagram of the control circuit used in the apparatus shown in FIG. 1.

FIG. 4 shows in block form a control system used to accomplish the desired paper control. The time that the paper must be immersed in the developing solution is a fixed quantity. Therefore, that time of immersion must be achieved by considering two remaining variables, namely, paper speed and path length. The paper speed is determined by the output rate of the printer, which leaves only path length for control by the operator. The path length is directly related to the vertical depth of the carriage 25. Therefore, once the desired path length is determined from paper input speed and desired time of immersion, that path length is converted to a desired depth of the carriage 25 in the tank. The depth of the carriage 25 is maintained by controlling the output speed of the paper. Once the appropriate depth is achieved, the output speed of the paper is matched to the input speed to maintain the desired depth.

The control function is maintained by a central processor unit (CPU) 73 that receives information related to the depth of the carriage 25. Based on that information, the CPU commands a motor controller 100 to adjust the output speed of a motor $M_1$ that drives the output roller 36. The CPU also commands a second motor controller 102 that operates a motor $M_0$ that drives the input roller 16. The carriage depth information is provided by the encoder 50 as described above. The encoder provides an input to a quadrature decoder 104, which, in turn, supplies the information to the CPU 73. The CPU can then use the carriage depth information to drive the motor controllers 100 and 102 to control the speed of input and output motors $M_0$ and $M_1$. A tension means is shown in FIG. 4 and is represented by a spring 56'; however, the weight 56 shown in FIG. 1 is also a suitable tension means.

As an alternative to the encoder 50, the depth of the carriage 25 can be sensed using an ultrasound detection means. Such an alternative is shown in FIG. 4 as an ultrasound controller/processor 106 that receives information from a transducer 108 mounted at the bottom of the tank 10. A target reflector 110 is attached to the bottom of the carriage 25 to reflect the sound waves from the transducer 108. The controller/processor provides data to the CPU 73, which then utilizes the data to determine the depth of the carriage 25 and adjusts the motor controller $M_1$ to bring the carriage to the desired depth.

As the paper web 12 passes over and under the various rollers that define the paper path, there can be a tendency for the paper to shift transversely to the path. With any such shift the potential exists for damage to the paper web 12 from misalignment of the web on the rollers. In order to maintain the web in alignment with the rollers the web's lateral position is monitored by an optical sensor mounted ahead of the feed rollers 16 and 18 in terms of web travel. The optical sensor 60 can be any one of many conventional types but must operate in a light spectrum to which the photosensitive paper is not reactive, e.g., infrared. The purpose of the sensor is to sense when the web 12 moves a predetermined amount to the right or left of the optimum paper path over the rollers. The sensor 60 develops a signal that is provided to a feedback circuit 62 that, in turn, provides a signal to a motor 64 that is mechanically connected to a roller 66 over which the paper web passes. The motor 64 physically tilts the roller 66 in a plane orthogonal to the direction of paper travel as necessary to realign the paper web 12 with the optimum path. When the paper web has been repositioned, the signal from the sensor 60 indicates the proper alignment and the motor 64 is deactivated. The motor 64 is illustrated as being physically connected by an arm 68 to one end of the roller 66. The motor 64 moves the arm 68 up and down and tilts the roller 66 in an appropriate direction to compensate for the transverse misalignment of the paper web 12 on the rollers.

Figure 5:
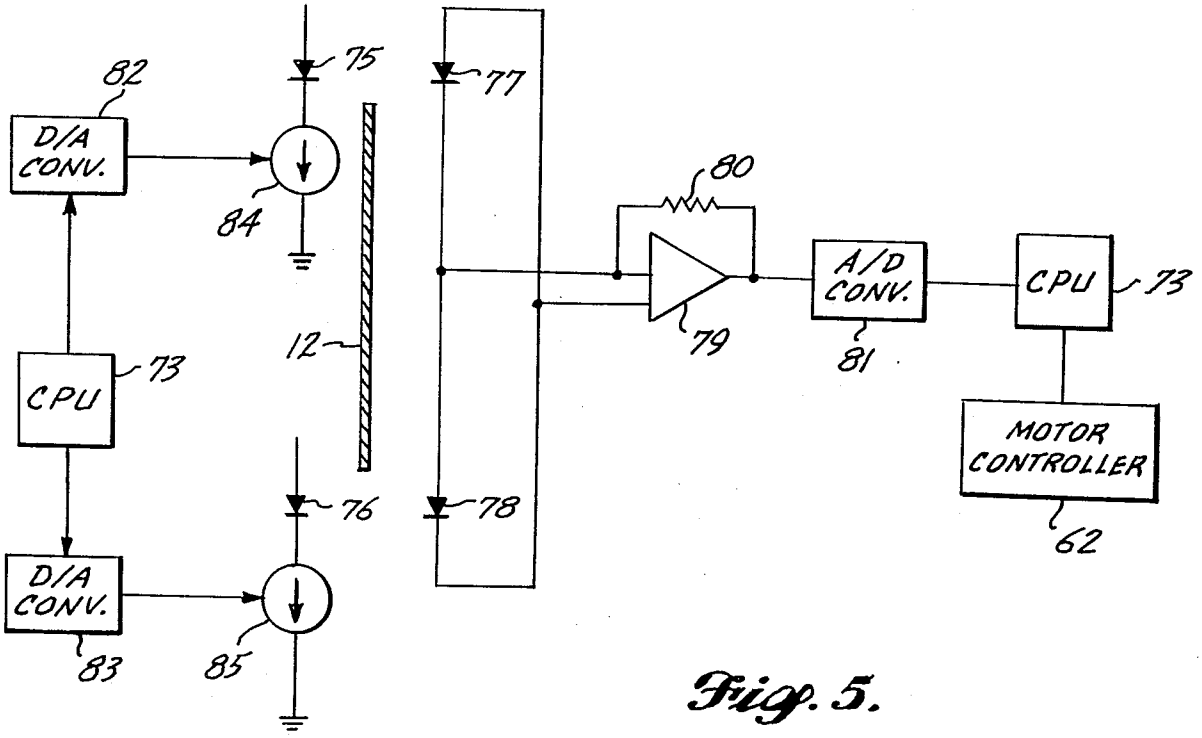
FIG. 5 is a schematic diagram of the paper path control used to correct for transverse motion of the paper with respect to the rollers.

FIG. 5 illustrates in greater detail the circuit used to correct for transverse motion of the paper web with respect to the rollers. The sensor 60 shown in FIG. 2 is comprised of two arrays of light-emitting diodes (LEDs) 75 and 76. The LEDs 75 and 76 are arranged so that, when the paper web 12 is in its desired location centered on the rollers, the LEDs 75 and 76 are not blocked by the web 12 and are spaced to the outside of the respective edges of the web 12. In this configuration light from both the LEDs can reach a respective photodiode 77 or 78 positioned on the backside of the web 12. The photodiodes 77 and 78 are connected anode to cathode to one another and to an operational amplifier 79. The photodiodes are operated in a current mode to permit linear response and a resistor 80 is used to convert the signal from op-amp 79 to a voltage. The output of the op-amp 79 is input to an analog-to-digital converter 81, which, in turn, provides its output to the CPU 73. The CPU processes the information from the A/D converter 81 and uses it to produce a control signal that is fed to the motor controller 62.

Initially, with the web 12 absent from or centered on the rollers, an operator using the central processor 73 sends a signal by way of digital-to-analog converters 82 and 83 to the drivers 84 and 85 that power LEDs 75 and 76 to vary the output of the LEDs until a null signal is present at the output of the A/D converter 81. Then, as the web 12 runs through the system, if there is a shift left or right of the web 12, the lightpath from one of the LEDs 75 or 76 to its associated photodiode, 77 or 78, will be partially or totally blocked. The change in the light received from the LED will cause a change in the output of that photosensor. The imbalance in the outputs of the photodiodes will show up as a positive or negative output from the A/D converter 81. The sign of the signal will depend on whether the left or right photodiode is blocked. The output from the A/D converter will cause the motor controller 62 to energize the motor 64 to tilt the roller 66 in order to move the paper web 12 sufficiently to center it on the rollers, as indicated by a balanced output from the photodiodes 77 and 78, which is indicated by a null output from the A/D converter 81. As mentioned above, the direction of tilt of the roller is determined by the sign of the output from the A/D converter 81.

Since the output of the photosensors is initially set to a balanced or null condition by adjusting the drivers of the LEDs 75 and 76, the system can compensate for aging of components or changes in ambient environment through simple adjustments to the outputs of the D/A converters 82 and 83.

Figure 3:
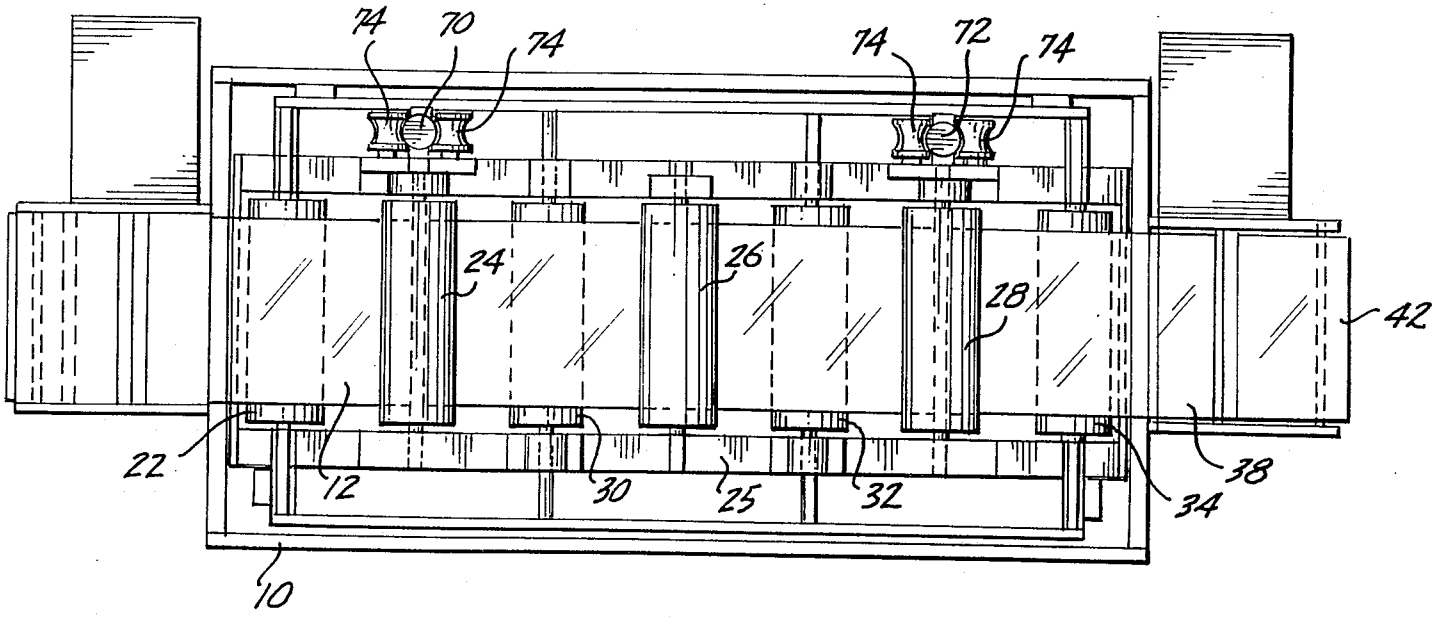
FIG. 3 is a plan view of the tank and web control apparatus of FIG. 2.

Another mechanism for maintaining the proper alignment of the paper web over the rollers as it passes through the solution is provided by rails 70 and 72 mounted vertically on the back of the tank. The rails are engaged by concave wheels 74 mounted in pairs on the carriage 25. As can be seen in the plan view of FIG. 3, the wheels 74 maintain the carriage both in fore/aft and side-to-side alignment, since the concave nature of the wheels 74 wraps around the round rail 70 or 72 attached to the rear wall of the tank 10. The carriage 25 is therefore held stable within the solution, minimizing any misalignment of the web 12 with the paper path rollers that might be due to transverse or fore/aft carriage motion. Also, there are an upper and lower set of wheels 74 that engage the rails 70 and 72 to prevent tipping of the carriage as a further stabilization of the carriage and minimize any misalignment of the web 12 with the paper path rollers due to carriage tilt or motion.

It should be clear to one of ordinary skill in the art that a system for adjusting the length of the paper path through a solution within a developing tank to maintain a constant immersion time of the paper within the solution has been described and illustrated. The apparatus is capable of maintaining a constant immersion time for the paper, despite changes in the input rate of paper to the solution. The system can be used in successive developing tanks, thereby eliminating the need to monitor the output from the solution in order to meter the input of the paper to the next processing step. By varying the length of the paper path in accordance with the rate of input of the paper, the time in solution is maintained a constant. A means is also provided for monitoring and correcting the alignment of the paper web with the rollers that define the paper path to avoid slippage of the paper from the rollers and consequent damage to the paper.

It will be understood by those of ordinary skill in the art and others that changes can be made to the above-described and illustrated invention while remaining within the scope of the invention. For example, while an encoder-based system has been described and illustrated for maintaining information as to the vertical position of the web within the tank, it would also be possible to use other types of sensors, such as ultrasonic sensors, to monitor such position. Also, the exact number and arrangement of rollers described and illustrated to define the paper path are not critical and other numbers of rollers and arrangements can be used to define the paper path through the solution. Since changes can be made to the illustrated embodiment, while remaining within the scope of the invention, the invention should be defined solely by reference to the appended claims.

The embodiments of the invention in which an exclusive property or privilege is claimed are defined as follows:

1. In a photographic developing system, a web-handling apparatus for controlling the length of time the web is immersed in a bath within a tank, said web-handling system including:

an input roller rotatably mounted at an input side of said tank for drivingly engaging said web and moving it into said bath;

an output roller rotatably mounted at an exit of said tank for drivingly engaging said web and moving it out of said bath;

a set of rollers for defining the path of said web within said tank;

means for sensing the length of the paper path in said tank and producing a signal related to said length; and means for controlling the speed of said input roller and said output roller in response to said path length signal to maintain the length of said paper path at a desired value.

2. The web-handling apparatus of claim 1, wherein said set of rollers includes:

a plurality of first rollers rotatably mounted on said tank in spaced relation to one another adjacent a top portion of said tank; and a plurality of second rollers rotatably mounted in spaced relation to one another and movable between a first position adjacent and in line with said first rollers and a second position vertically spaced from said first rollers, said second rollers being supported by said web when in said second position.

3. The web-handling apparatus of claim 2, further including a carriage movably mounted in said tank upon which said second rollers are mounted.

4. The web-handling apparatus of claim 3, further including means associated with said tank for raising said carriage to move said rollers back to their first position.

5. The web-handling apparatus of claim 4, wherein said carriage-raising means includes a basket suspended from said tank below said carriage, said basket supporting said carriage when said rollers are in said first position and said basket being movable to a position substantially at the bottom of said tank when said rollers are supported by said web.

6. The web-handling apparatus of claim 2, further including sensing means positioned adjacent the input of said tank for producing a position signal indicative of the position of said web transverse to said paper path.

7. The web-handling apparatus of claim 6, further including a positioning roller adjacent said sensing means, said positioning roller movable in a plane orthogonal to said paper path and roller adjustment means associated with said positioning roller for receiving said position signal from said sensing means, said roller adjustment means being responsive to said position signal from said sensing means to move said positioning roller to maintain said web in line with said paper path.

8. The web-handling apparatus of claim 3, wherein said paper path length-sensing means includes a carriage position-sensing means for sensing the vertical position of said carriage with respect to said tank.

9. The web-handling apparatus of claim 8, wherein said carriage position-sensing means includes:

a cable having a first end attached to said carriage;

a tensioning means attached to a second end of said cable;

a spindle rotatably mounted on said tank, said cable passing over said spindle and turning said spindle as said cable is drawn over said spindle due to the movement of said carriage; and, an encoder associated with said tank, said spindle being drivingly mounted on said encoder, such that rotation of said spindle rotates said encoder to provide a signal representative of the vertical position of said carriage.

10. The web-handling apparatus of claim 8, wherein said carriage position-sensing means includes:

an ultrasonic transducer adjacent the bottom of said tank for transmitting sound waves toward said carriage and receiving said sound waves reflected from said carriage;

an ultrasonic processor means for monitoring said transducer and producing a carriage position signal derived from the time interval between transmission of said sound waves and reception of said reflected sound waves; and a central processor for receiving said carriage position signal and producing motor control signals related to said carriage position signal and sending said motor control signals to said speed-controlling means.

11. The web-handling apparatus of claim 3, further including:

at least one rail vertically mounted on a first wall of said tank; and, a pair of guide wheels mounted on said carriage and adapted to engage opposing sides of said rail to maintain lateral stability of said carriage.

12. The web-handling apparatus of claim 11, further including a second pair of guide wheels vertically spaced from said first set of guide wheels mounted on said carriage and adapted to engage opposing sides of said guide rail, said first and second pairs of guide wheels cooperating to minimize pitching motion of said carriage.

13. The web-handling apparatus of claim 12, further including a second guide rail vertically mounted on said first wall of said tank horizontally spaced from said first guide rail and a third pair of guide wheels mounted on said carriage horizontally spaced from said first and second pairs of guide wheels, said third pair of guide wheels adapted to engage opposing sides of said second guide rail.

14. The web-handling apparatus of claim 3, further including:

upper guide track means mounted on said tank and lower guide track means mounted on said carriage, said upper and lower guide track means cooperating to form a path for said web when said second rollers are in their first position, said lower guide track means moving with said carriage.

15. The web-handling apparatus of claim 7, wherein said sensing means includes:

first and second light-emitting diodes positioned adjacent respective edges of said web;

first and second photosensors, respectively, associated with said first and second light-emitting diodes, said photosensors positioned adjacent the edges of said web, said web lying between said light-emitting diodes and their respective photosensors such that when said web is in its desired position there is a clear light path from each light-emitting diode to its associated photosensor and transverse motion of said web will cause at least a partial blockage of one of said light paths; and a processor means for receiving the output of said first and second photosensors and processing said output to produce said position signal related to the transverse position of said web, and providing said position signal to said roller adjustment means.

16. The web-handling apparatus of claim 15, further including initializing means associated with said light-emitting diodes for producing a signal to said light-emitting diodes that results in said position signal from said processor means being a null.

* * * * *